United States Patent [19]

Ruehl

[11] 4,447,105

[45] May 8, 1984

[54] TERMINAL BRIDGING ADAPTER

[75] Inventor: William E. Ruehl, Wheeling, Ill.

[73] Assignee: Illinois Tool Works Inc., Chicago, Ill.

[21] Appl. No.: 376,862

[22] Filed: May 10, 1982

[51] Int. Cl.[3] ..... H01R 3/00; H01R 13/66

[52] U.S. Cl. ..... 339/113 R; 174/52 R; 339/147 R

[58] Field of Search ..... 339/113 R, 113 B, 147 R, 339/97 P, 147 P, 207 R, 208, 210 R, 210 M, 222; 174/52 R, 92, 138 F

[56] References Cited

U.S. PATENT DOCUMENTS

| | | | |
|---|---|---|---|
| 3,007,599 | 11/1961 | Greaseley | 174/52 R |
| 4,113,340 | 9/1978 | Rapata | 339/113 R |
| 4,113,341 | 9/1978 | Hughes | 339/222 X |
| 4,116,524 | 9/1978 | DeNigris et al. | 339/113 R |
| 4,126,369 | 11/1978 | Rapata et al. | 339/113 R |

*Primary Examiner*—Eugene F. Desmond
*Assistant Examiner*—Steven C. Bishop
*Attorney, Agent, or Firm*—Thomas W. Buckman; John P. O'Brien

[57] ABSTRACT

The invention provides a terminal bridging adapter for mounting at least one electrical component in electrical series circuit between each of a plurality of spaced rows of substantially colinear terminals wherein the electrical component has dimensions greater than the space between each of said spaced rows of terminals. This terminal bridging adapter comprises a housing constructed of insulative material and defining a connector portion including at least two open ended ports for receiving a like number of terminals therein. These ports are respectively disposed so as to be positionable in registry with a like number of terminals. A component portion also defined in the housing includes at least one component cavity for receiving at least one electrical component and is offset from said ports so as to be positionable offset to one side of the terminals. A connection cavity is also defined in the housing and communicates with the component cavity and with the two ports to receive leads of the electrical component therethrough so as to complete respective electrical circuits to each of said ports.

12 Claims, 6 Drawing Figures

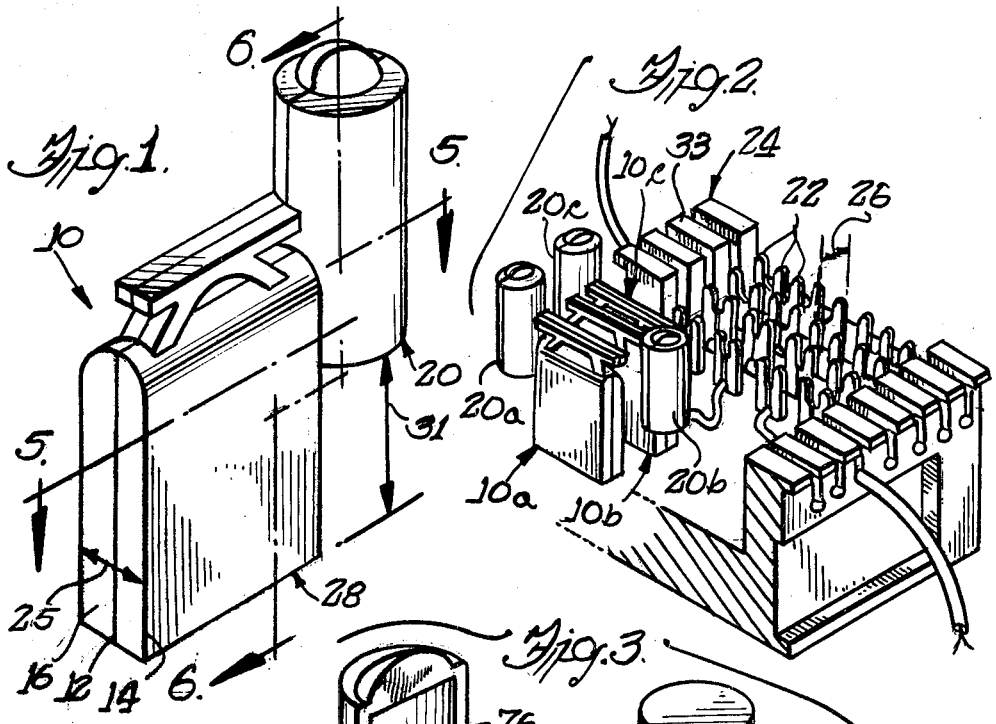
Fig. 1.
Fig. 2.
6.
5.
10
20
31
28
25
16
12
14
10c
33
24
20c
22
26
20a
10a
10b
20b
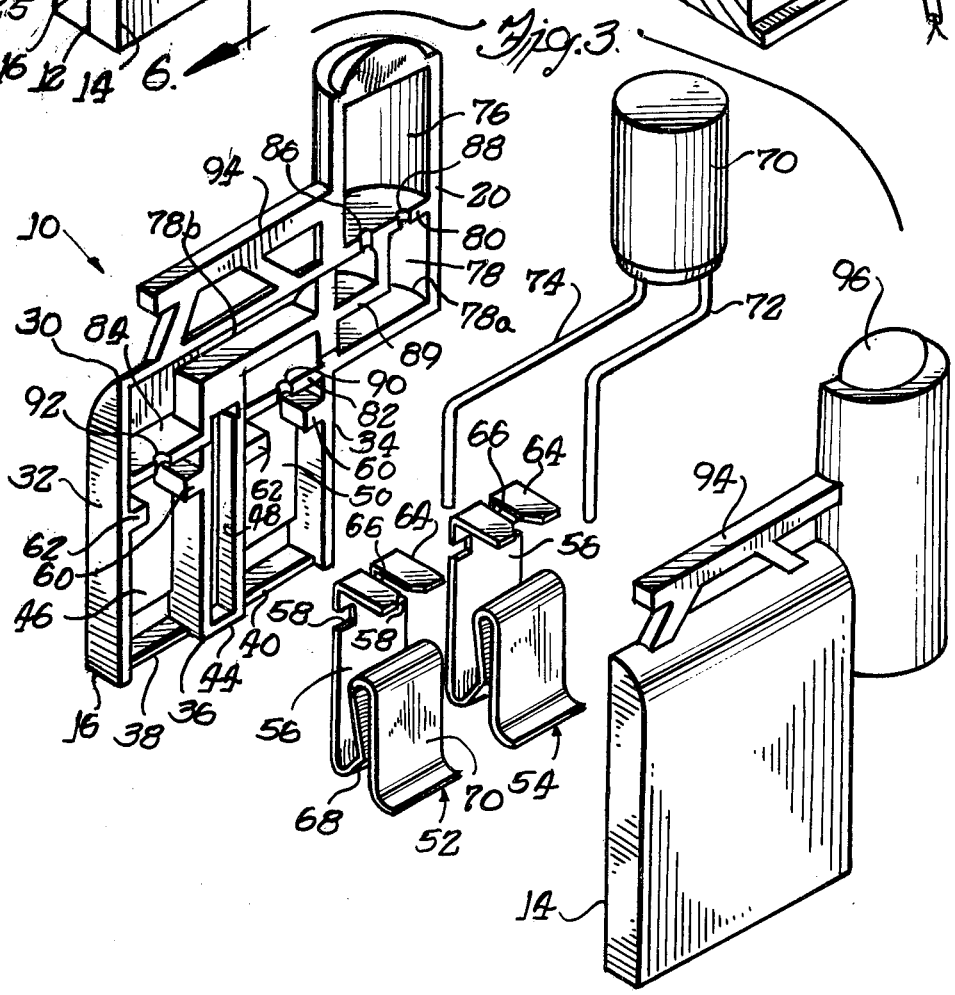
Fig. 3.
76
88
86
94
20
80
78b
78
78a
10
74
70
72
96
30
84
89
90
92
82
34
60
32
62
50
48
66
64
62
60
46
58
40
44
36
38
16
56
68
52
54
14

96
94
76
70
20
30
89
80
74
88
78b
72
84
92
82
78a
58
90
78
62
60
32
58
66
60
34
46
50
48
28
16
52
36
44
54

10
96
70
76
20
80
88
72
89
78a
90
64
62
52
28
16
50
14
44
54
68
70

10

94
92
16
28
62
86
70
20
88
14
84
44
82
90
80

TERMINAL BRIDGING ADAPTER

BACKGROUND OF THE INVENTION

This invention relates generally to an adapter device for facilitating the mounting of an electrical or electronic component to the terminals of a terminal block, and more particularly to a terminal bridging adapter for permitting the mounting of a plurality of such electrical or electronic components to a plurality of adjacent terminals on a matrix-type terminal block arrangement of the type used with key telephone systems.

Terminal bridging devices for mounting components to such matrix arrangements of terminals are generally known in the art. For example, U.S. Pat. Nos. 4,113,340; 4,116,524 and 4,126,369 disclose such devices. However, all of these prior art devices are directed to the mounting of components which are smaller in their transverse dimensions than the spaces available between the spaced parallel rows of terminals in such a terminal block. Hence, a problem has arisen with respect to mounting larger components to terminals in adjacent rows in such a terminal block assembly.

Prior to the invention of the devices set forth in the above-referenced U.S. patents, the addition of electrical or electronic components to such terminal blocks required the provision of independent mounting space for each component and the hand-running of suitable leads from appropriate terminals in the terminal block to the component. Such operation is labor-intensive, time-consuming and expensive. Moreover, the space generally allotted for telephone equipment is minimal and hence the addition of such other components is restricted.

Attempts have been made to remove terminals from the blocks and wire electric components directly to adjacent terminals. However, component lead wires are often of a larger diameter than the telephone lead wires commonly used and hence are difficult to maintain in acceptable electrical and mechanical contact with these terminals. Additionally, the labor of removing terminals from a terminal block and installation of electric or electronic components therein is difficult and expensive at best. Further, the removal of terminals from a block restricts the future usage of that block for later possible modifications.

While the adapter devices disclosed in the above-referenced U.S. patents have proven useful in solving a number of these problems, there remains room for improvement. In particular, these prior art devices cannot be used for the mounting of electrical or electronic components whose transverse dimensions are greater than the space normally provided between adjacent rows of terminals on such a terminal block assembly.

Such larger components may comprise fuses for example. In this regard, telephone equipment inside a building is usually protected from power transients caused by a lightning, damaged power lines or the like by a line protector device which is designed to shunt high potential to ground. However, damaging currents at less than the selected high voltage potential can and do occasionally fail to trip this protector device and thus may damage the telephone equipment. Moreover, even relatively large AC currents at large AC voltages may pass such a protector because the AC voltage swings between positive and negative values and hence fails to reach the preselected tripping potential of the protector. Additionally, some time delay is inherent in such protectors, whereby currents may "sneak" past the protector and damage the telephone equipment.

While a suitable 500- to 600-volt fuse would substantially prevent such "sneak" currents, such fuses are difficult to mount to standard terminal blocks. In particular, the spacing between rows of terminals on these blocks are commonly on the order of 0.200 to 0.250 inch centers, while such fuses are generally on the order of 0.300 inches in diameter. Hence, terminal bridging adapter devices of the type set forth in the above-mentioned U.S. patents will be ineffective in providing suitable mounting for such fuses. Advantageously, the present invention is particularly useful for providing a simple and inexpensive means for mounting such fuses to the terminals of such a terminal block assembly.

OBJECTS AND SUMMARY OF THE INVENTION

Accordingly, it is a general object of the invention to provide a novel and improved terminal bridging adapter.

A more specific object is to provide such a terminal bridging adapter which permits the mounting of electrical or electronic components of greater transverse dimension than the spacing between adjacent rows of terminals to such adjacent rows of terminals without interference therebetween and without modification of the terminal block.

A related object is to provide for a visual monitoring capability of the electronic component within the terminal bridging adapter.

A further object is to provide such a terminal bridging adapter which is relatively simple and inexpensive in its manufacture and assembly and yet surprisingly simple to install and highly reliable in operation.

Briefly, and in accordance with the foregoing objects, the invention provides a terminal bridging adapter for mounting at least one electrical component in electrical series circuit between each of a plurality of spaced rows of substantially colinear terminals wherein the electrical component has dimensions greater than the space between each of said spaced rows of terminals. In accordance with the invention, this terminal bridging adapter comprises a housing constructed of insulative material and defining a connector portion including at least two open ended ports for receiving a like number of terminals therein, said ports being respectively disposed so as to be positionable in registry with said like number of terminals, a component portion also defined in said housing and including at least one component cavity for receiving said at least one electrical component and offset from said ports so as to be positionable offset to one side of said like number of terminals, and a connection cavity defined in said housing and communicating with said at least one component cavity and with said at least two ports to receive leads of said at least one component therethrough to complete respective electrical circuits to each of said ports, whereby a plurality of like terminal bridging adapters are respectively mountable to a like plurality of said spaced rows of terminals such that the component cavities of the plurality of terminal bridging adapters may be respectively offset to alternating sides of the plurality of spaced rows of terminals so as to avoid mutual interference between said mounted terminal bridging adapters.

BRIEF DESCRIPTION OF THE DRAWINGS

The foregoing as well as other objects, features and advantages of the invention will become more readily apparent upon reading the following description of the illustrated embodiment, together with reference to the accompanying drawings, wherein:

FIG. 1 is a perspective view of a terminal bridging adapter assembly in accordance with the invention;

FIG. 2 is a top perspective view of a typical terminal block assembly with which a plurality of terminal bridging adapters in accordance with the invention have been assembled;

FIG. 3 is an exploded perspective view of the terminal bridging adapter assembly of FIG. 1;

DETAILED DESCRIPTION OF THE ILLUSTRATED EMBODIMENT

Figure 4:
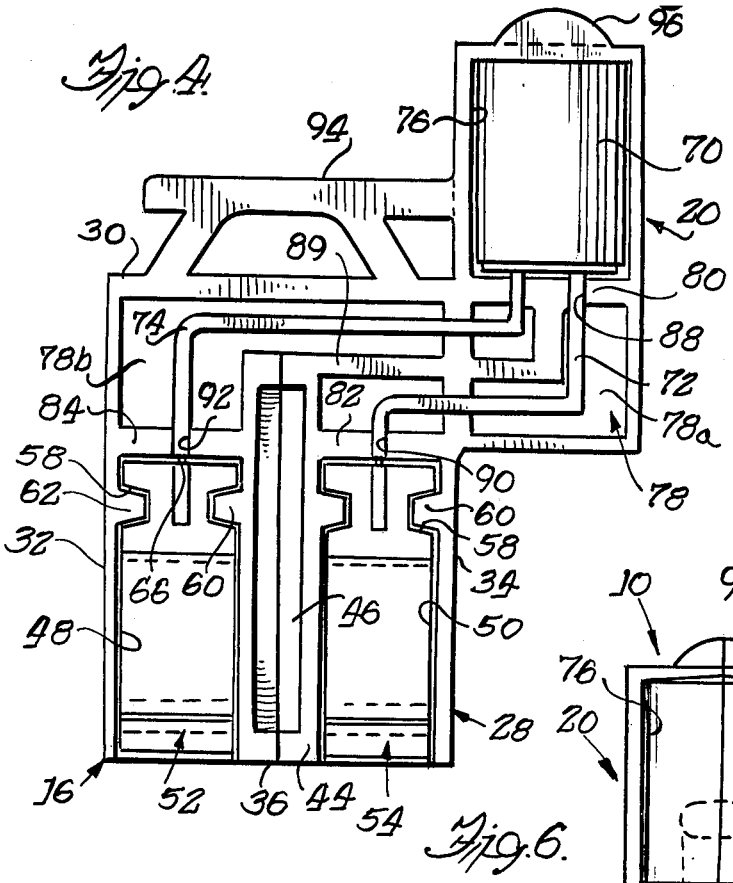
FIG. 4 is a side elevation of one housing component or half of a terminal bridging adapter assembly in accordance with the invention.
Figure 6:
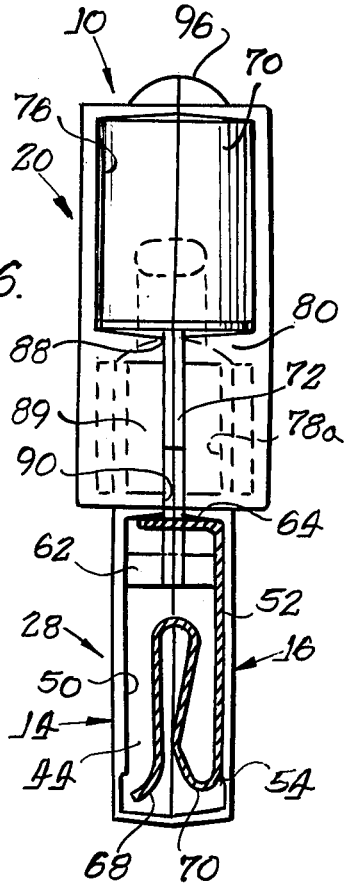
FIG. 6 is a developmental view taken generally along the line 6—6 of FIG. 1.
Figure 5:
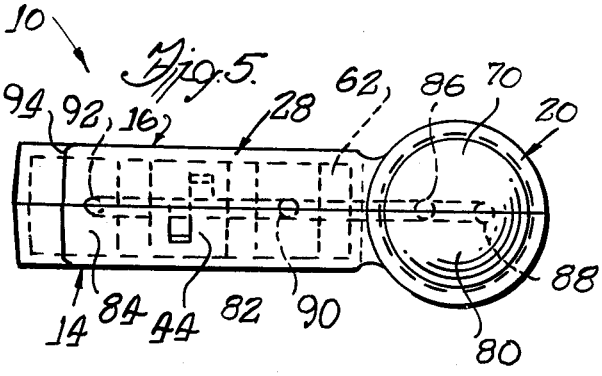
FIG. 5 is a developmental view taken generally along the line 5—5 of FIG. 1.

Referring now to the drawings and initially to FIG. 1, a terminal bridging adapter in accordance with the invention is designated generally by the reference numeral 10. Generally speaking, this adapter 10 includes a housing 12 which preferably comprises a pair of complementary housing halves 14, 16. This housing 12 defines a terminal bridging or connector portion 28 and a component-receiving portion 20. Advantageously, the component-receiving portion 20 is carried offset to one side of the terminal bridging or connector portion 28 and is also vertically offset or raised with respect thereto. Moreover, the component-receiving portion 20 is of greater transverse dimension than the terminal bridging or connector portion 28.

Referring now also to FIG. 2, the foregoing structural features and arrangement of the terminal bridging adapter 10 will be seen to advantageously facilitate the mounting of a number of such terminal bridging adapters 10*a*, 10*b* and 10*c* to adjacent rows of terminals 22 carried in a conventional terminal block assembly 24. Hence, the width or transverse dimension 25 of the terminal bridging or receiving portion 28 is less than the center-to-center dimension 26 between adjacent rows of terminals. However, as mentioned above, the component-receiving portion 20 may have a larger diameter or transverse dimension.

In this latter regard, the greater transverse dimension of this component-receiving portion 20 is accommodated by mounting the successive terminal bridging assemblies 10*a*, 10*b*, 10*c*, etc., in oppositely facing or oriented directions upon successive rows of terminals 22. Advantageously, the offset location of the component-receiving portion 20 facilitates such mounting. This offset construction allows the width or transverse dimension of the component portion 20 to be almost twice the center-to-center dimension 26 between adjacent rows of terminals 22. Hence, the terminal bridging adapter 10 and in particular the offset component-receiving portion 20 thereof may accommodate an electrical or electronic component of somewhat greater transverse dimension than could otherwise be accommodated between the adjacent rows of terminals 22. Moreover, the vertical spacing 31 provided between the bottommost portion of the component-receiving portion and the bottommost edge of the terminal bridging portion 28 permits the component-receiving portion 20 to readily clear either the sidewall 33 of the block assembly 24 or adjacent ones of the terminals 22 carried therein.

Referring now to FIGS. 3 through 6, inclusive, further details of the structure of the terminal bridging assembly 10 will be described. Initially, it is noted that the complementary housing sections 14 and 16 comprise substantially complementary halves, each being substantially a mirror image of the other. Hence, FIG. 4 illustrates but one of these housing halves 16, it being understood that the housing half 14 has a mirror image thereof. Additionally, it will be appreciated that the housing halves 14, 16 are preferably formed of insulative or dielectric material to avoid inadvertent electrical coupling of the respective adjacent rows of terminals 22 upon installation of adjacent assemblies 10 in accordance with the invention thereupon.

The portion of each of the housing halves 14, 16 defining the terminal bridging portion 28 comprises a generally thin-walled, box-like member substantially rectangular in configuration. Hence, the terminal bridging portion 28 generally comprises a top end wall 30, sidewalls 32 and 34 and a bottom 36 having a pair of apertures or ports 38 and 40 spaced apart from one another. These ports 38 and 40 lie in an in-line or side-by-side relationship along the common joining line of the two halves 14 and 16. In the illustrated embodiment, the top wall 30 is generally curvilinear in configuration.

The terminal bridging portion 28 in each housing half 14, 16 carries a centrally disposed longitudinal member 44, which is preferably recessed at a central portion 46 to conserve material. This longitudinal member 44 serves to separate and define a pair of spaced, longitudinally disposed chambers 48 and 50 which communicate with the openings 38 and 40, respectively. These chambers 48 and 50 defined by the respective housing halves 14 and 16 advantageously receive and retain a pair of terminal clip-type connector elements 52 and 54 for achieving electrical and mechanical contact with a given pair of terminals 22 of the terminal block assembly 24. Briefly, these terminal clip connectors 52 and 54 each comprises a flat, elongated first portion 56 with a pair of aligned notches 58 opening outwardly to the opposite edges of the flat portion 56. Cooperatively, each of the chambers 48 and 50 has formed therein a pair of opposing inwardly projecting ribs 60, 62 which advantageously interfit with these notches 58 for receiving and retaining the respective terminal clip connectors 52 and 54 within the chambers 48 and 50.

Each of these terminal clips or connectors 52 and 54 further comprises a flange 64 formed substantially ar right angles to and at one end of the flat portion 56. This flange 64 is preferably slotted as indicated by reference numeral 66 to form a solderless wire connection means. At the opposite end of the flat, elongated portion 56 is an integral, oppositely bent second portion 68 and connected thereto a further, integral and oppositely bent (with respect to portion 68) third portion 70. These reversely bent portions 68 and 70 thus define a smooth, open throat therebetween with the spacing being adapted for acceptance of the terminals 22 in a resiliently gripped relation. Preferably, the lowermost extremities of these two oppositely bent portions 68 and 70 are flared oppositely outwardly to aid in positioning and guiding a terminal 22 into such resiliently gripped relation therewithin.

An electrical component 70 to be carried within the component-receiving portion 20 of the adapter 10 comprises a fuse in accordance with one practical and preferred form of the invention. However, other electrical or electronic components may be accommodated without departing from the invention. In the illustrated embodiment, this fuse 70 comprises a generally right cylindrical body and a pair of downwardly depending electrical leads 72, 74. Cooperatively, the component-receiving portion 20 defines therein a substantially right cylindrical component cavity or chamber 76 for receiving the body of the fuse or other component 70. It will be appreciated that the chamber or compartment 76 may be alternatively configured to accept other components without departing from the invention.

Intermediate the two chambers 48, 50 and the component-receiving chamber 76 the housing halves 14, 16 define a generally transversely extending connection cavity 78. This latter cavity 78 is provided for feeding the leads 72, 74 from the body of the fuse 70 to the chambers 48 and 50 for mechanical and electrical connection with the slots 66 defined in the respective terminal clips or connectors 52 and 54. Preferably, this connection cavity 78 includes a transverse wall 89, which defines a pair of electrically and physically separate cavities **78*a*, 78*b* for separately carrying the two leads 72 and 74 electrically isolated one from the other. Moreover, in the illustrated embodiment, the cavities 78*a* and 78*b* are separated respectively from the component-receiving compartment 76 and the chambers 48 and 50 by respective wall portions 80, 82 and 84. In this regard, the wall 80 defines a bottom end wall of the component cavity 76, while the wall portions 82, 84 define top end walls of the respective chambers 48, 50**.

To permit passage of the respective leads 72 and 74 through the respective walls 80, 82 and 84, respective through bores 86, 88, 90 and 92 (to be described further below) are provided in each of these wall portions. It will be appreciated that these respective wall portions 80, 82 and 84 and the bores therein are defined by the respective housing halves 14 and 16, substantially one-half of each wall 80, 82 and 84 and of the through bore therein being defined in each of these housing halves.

Referring first to the wall 80, in addition to defining a bottom of the compartment 76 for securely mounting the component or fuse, the bores 86 and 88 are spaced apart by substantially the same amount as the spacing between the lead 72 and 74 where they depend from the fuse body 70. Hence, these bores 86 and 80 further serve to securely hold and guide the leads 72 and 74 as they pass therethrough. Additionally, the transverse wall 89 joins the wall 80 intermediate the bores 86 and 88 so that the leads 72, 74 are respectively guided to the two cavities **78*a*, 78*b*. The wall 89 then runs transversely to join the longitudinal member 44 which separates the two chambers 48, 50. Cooperatively, the top wall portions 82 and 84 of the respective chambers 48 and 50 each carries one of the through bores 90, 92 centrally located therein. These bores 90, 92 advantageously aid in properly positioning the respective leads 72 and 74 for interconnection with the slots 66 of the respective terminal clip connectors 52 and 54**.

In accordance with a preferred form of the invention, a support leg or strut structure 94 is also provided for additionally supporting the component-receiving portion 20 with respect to the terminal bridging or connector portion 28 of the adapter 10. As with all of the foregoing described structure, this latter support strut structure 94 is integrally formed in and defined substantially one-half by each of the housing halves 14, 16. In accordance with an additional preferred form of the invention, a topmost portion or wall 96 of the component-receiving portion 20 is preferably formed of an translucent or transparent material to permit observation of the fuse 70 or other component carried within the cavity 76.

What has been illustrated and described herein is a novel terminal bridging adapter for facilitating electrical connection of an electrical component such as a fuse between selected terminals in a terminal block assembly. While the invention has been described herein with reference to a preferred embodiment, the invention is not limited thereto. Those skilled in the art may devise various changes, alternatives and modifications upon reading the foregoing description. The invention includes such alternatives, changes and modifications insofar as they fall within the spirit and scope of the appended claims.

The invention is claimed as follows:

1. A terminal bridging adapter for mounting an electrical component in electrical series circuit between a selected pair of a plurality of spaced pairs of substantially colinear terminals wherein the electrical component has dimensions greater than the space between each of said spaced pairs of substantially colinear terminals, said terminal bridging adapter comprising: a housing constructed of insulative material and defining a connector portion including a pair of spaced chambers each for receiving an electrical connector member for connection to one terminal of one of said pairs of terminals and each chamber having one open end for receiving said one terminal, said chambers being positionable in registry with one of said pairs of terminals, a component portion also defined in said housing and including a component cavity for receiving said electrical component and offset from said chambers so as to be positionable offset to one side of said one pair of terminals, and a connection cavity defined in said housing and communicating with said component cavity and with said chambers to receive at least two leads of said component therethrough for respective electrical connection with said connectors carried within said chambers, whereby a plurality of like terminal bridging adapters are respectively mountable to a like plurality of said spaced pairs of terminals such that the component cavities of the plurality of terminal bridging adapters may be respectively offset to alternating sides of the plurality of spaced pairs of terminals so as to avoid mutual interference between said terminal bridging adapters.

2. A terminal bridging adapter according to claim 1 wherein said spaced chambers are arranged substantially side-by-side in colinear arrangement so as to interfit with one of said colinear pairs of terminals, and wherein said spaced pairs of colinear terminals are further arranged in substantially parallel planes, whereby a plurality of said terminal bridging adapters are mountable to a plurality of said spaced pairs of terminals in a substantially parallel and spaced apart condition.

3. A terminal bridging adapter according to claim 1 wherein said housing comprises complementary housing halves, each housing half being substantially a mirror image of the other housing half.

4. A terminal bridging adapter according to claim 1 wherein said component cavity is upwardly offset with respect to said pair of chambers and wherein said connection cavity is located intermediate a topmost end of said chambers and a bottommost portion of said component cavity.

5. A terminal bridging adapter according to claim 4 wherein said pair of chambers are substantially identical and arranged in side-by-side colinear relation.

6. A terminal bridging adapter according to claim 1 or claim 5 and further including support strut means integrally formed with said housing for supporting said component portion with respect to said connector portion.

7. A terminal bridging adapter according to claim 1 wherein said chambers include retaining means for non-removably retaining said connectors.

8. A terminal bridging adapter according to claim 7 wherein said retaining means comprises rib means formed in each of said chambers for aligning with and engaging slot means in said connectors.

9. A terminal bridging adapter according to claim 1 wherein said housing further comprises an transparent or translucent material forming at least a portion of said housing component portion to permit visual observation of at least a portion of said electrical component carried in said component cavity.

10. A terminal bridging adapter according to claim 1 wherein said connection cavity comprises a pair of electrically isolated connection cavities running respectively intermediate each said chamber and said component cavity, and wherein said chambers and said component cavity are respectively separated by walls from said connection cavities, said walls comprising a top end wall of each of said chambers and a bottom end wall of said component cavity, and further including bores through the respective end walls of said chambers and said component cavity, each bore being adapted to receive at least one component lead therethrough.

11. A terminal bridging adapter according to claim 10 wherein said connection cavity runs substantially transversely to the chambers and the component cavity and wherein said pair of connection cavities are defined by a continuous wall within said connection cavity running substantially in an unbroken fashion from a point intermediate said chambers to an intermediate portion of the bottom end wall of said component cavity.

12. A terminal bridging adapter for mounting at least one electrical component in electrical series circuit between a selected pair of a plurality of spaced rows of substantially colinear terminals wherein the electrical component has dimensions greater than the space between each of said spaced rows of terminals, said terminal bridging adapter comprising: a housing constructed of insulative material and defining a connector portion including at least two open ended chambers for receiving a like number of terminals therein, said chambers being respectively disposed so as to be positionable in registry with said like number of terminals, a component portion also defined in said housing and including at least one component cavity for receiving said at least one electrical component and offset from said chambers so as to be positionable offset to one side of said like number of terminals, and a connection cavity defined in said housing and communicating with said at least one component cavity and with said at least two chambers to receive leads of said at least one component therethrough to complete respective electrical circuits to each of said chambers, whereby a plurality of like terminal bridging adapters are respectively mountable to a like plurality of said spaced rows of terminals such that the component cavities of the plurality of terminal bridging adapters may be respectively offset to alternating sides of the plurality of spaced rows of terminals so as to avoid mutual interference between said mounted terminal bridging adapters.

* * * * *